United States Patent [19]

Andersson

[11] Patent Number: 4,959,991

[45] Date of Patent: Oct. 2, 1990

[54] VEHICLE CHASSIS SUPPORT

[75] Inventor: Thorbjorn B. Andersson, Esketeuna, Sweden

[73] Assignee: Car-O-Liner Company, Wixom, Mich.

[21] Appl. No.: 459,138

[22] Filed: Dec. 29, 1989

[51] Int. Cl.[5] ..... B21D 1/12

[52] U.S. Cl. ..... 72/457; 72/705; 269/47

[58] Field of Search ..... 72/457, 705; 269/47, 269/52

[56] References Cited

U.S. PATENT DOCUMENTS

| | | | |
|---|---|---|---|
| 3,625,047 | 12/1971 | Lunardini | 72/705 |
| 3,818,579 | 6/1974 | Pietrelli et al. | 72/705 |
| 4,505,145 | 3/1985 | Bergstrom et al. | 72/705 |

*Primary Examiner*—Lowell A. Larson

*Attorney, Agent, or Firm*—Barnes, Kisselle, Raisch, Choate, Whittemore & Hulbert

[57] ABSTRACT

A support for mounting a vehicle chassis on an alignment bench. The support has a threaded bushing telescopically received in a sleeve fixed to a carrier arm. In use, the axial length of the bushing and sleeve assembly can be adjusted so that when received between the side walls of an attachment bracket for a vehicle suspension component, they lie closely adjacent to and preferably bear on the side walls. In use, the shank of a bolt is inserted through the side walls of the attachment bracket and the bushing and sleeve assembly received between them and is preferably retained therein by a nut received thereon. When desired, this mounting support permits the vehicle to be pivoted relative to the bench while still secured thereon by the support.

6 Claims, 2 Drawing Sheets

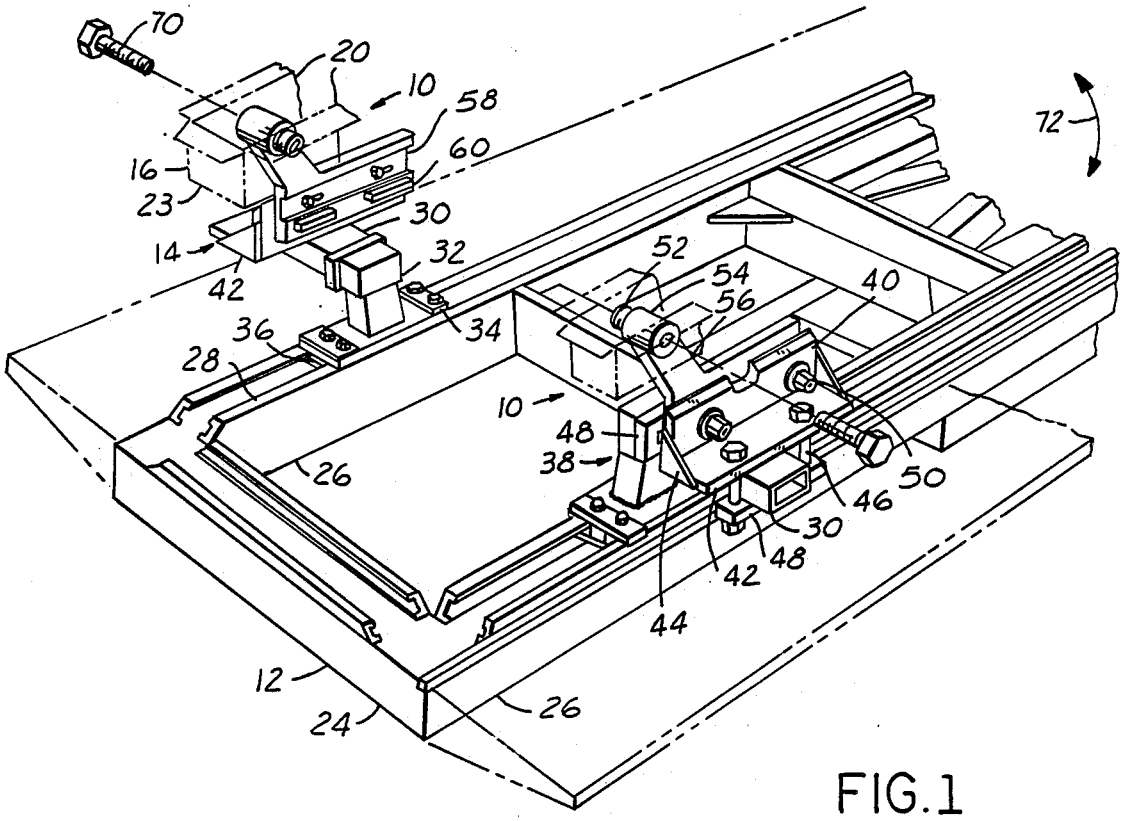
FIG.1
FIG.2
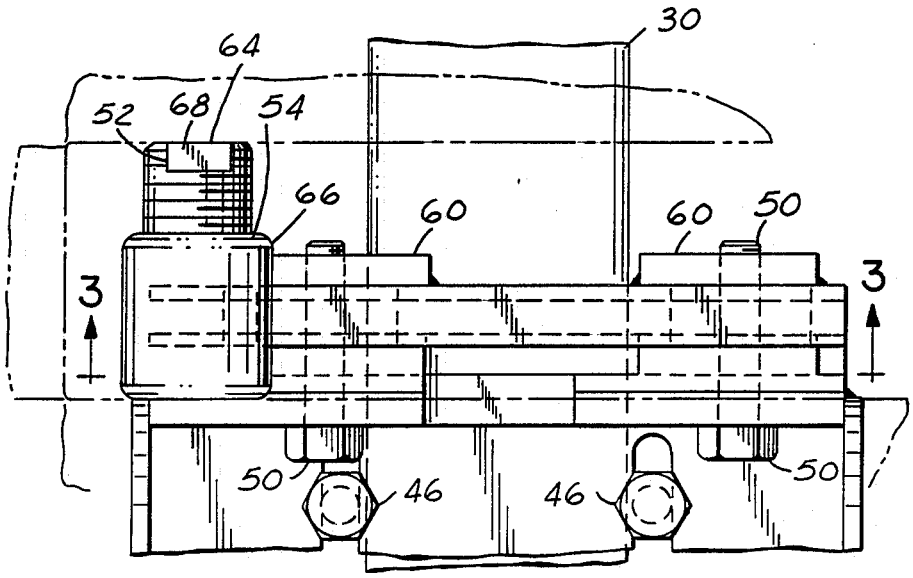

VEHICLE CHASSIS SUPPORT

FIELD OF THE INVENTION

This invention relates to a vehicle chassis support for securing a vehicle on an alignment or straightening bench so that the vehicle is supported and secured for straightening operations.

BACKGROUND OF THE INVENTION

Straightening devices or alignment benches are known. These devices provide a frame for mounting and supporting a vehicle while forces are applied to straighten the vehicle or while other repair work is being done. U.S. Pat. No. 4,845,974, Bergstrom, discloses an alignment bench for straightening deformed vehicles and pinch clamps for securing a vehicle chassis to the bench.

U.S. Pat. No. 3,818,579, Pietrelli et al, discloses a device for mounting a vehicle chassis on an alignment bench. This device engages the bolt of a suspension member from the exterior of its attachment bracket which has a pair of spaced apart plates through which the bolt extends. In use, this device requires considerable clearance to effect such an attachment and encumbers the space around it so that it is difficult and frequently impossible to work on the vehicle in the area immediately around the attachment bracket.

SUMMARY OF THE INVENTION

A vehicle chassis support with a bushing adjustably telescoped in a sleeve which is supported by an arm to be disposed between the spaced apart plates of a vehicle attachment bracket with the bushing and sleeve telescopically extended to bear on the plates. The bracket is secured to the support by a bolt received in generally aligned holes through the bracket plates, bushing and sleeve. For bearing firmly on the bracket plates, preferably the outer end faces of the sleeve and bushing are flat. To axially extend and retract the telescoped sleeve and bushing, preferably they have complimentary threads and the bushing has a non-circular portion engagable by a wrench or other hand tool to rotate it.

Typically, the vehicle mounting bracket is generally U-shaped with side walls or plates through which a mounting bolt extends to attach a spring or other suspension component between the plates. Usually, the plates and suspension component are drawn together by a nut threaded on the bolt.

In using the support, the mounting bolt and suspension component are first removed from the bracket. Then the sleeve and the bushing are inserted between the plates of the bracket and preferably adjusted so that their outer ends bear on the plates. The mounting bolt is then reinserted through the bracket plates and the bushing and sleeve. Preferably, the nut is resecured on the mounting bolt to firmly attach the bracket to the support.

Objects, features and advantages of this invention are to provide a chassis support which permits a vehicle to pivot relative to the support and an alignment bench, can be used where there is little clearance around a vehicle mounting bracket, provides maximum clearance around the support and bracket for working on the vehicle, is rugged, durable, has a long in service life and is of simplified design and economical manufacture and assembly.

BRIEF DESCRIPTION OF THE DRAWINGS

FIG. 1 is a perspective view of a support embodying the invention mounted on an alignment bench;

FIG. 2 is an enlarged and fragmentary top view of the support of FIG. 1;

DETAILED DESCRIPTION

Figure 3:
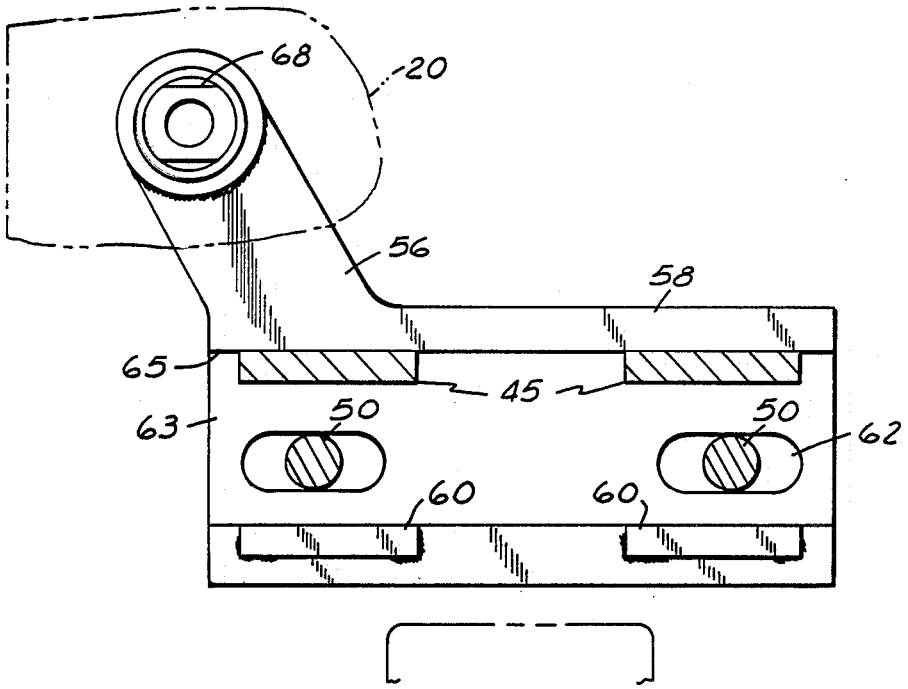
FIG. 3 is a fragmentary sectional side view of the support taken generally on line 3—3 of FIG. 2.

FIG. 1 illustrates a pair of vehicle support devices 10 embodying this invention for supporting the chassis of a vehicle (not shown) on an alignment bench 12. Each support 10 is received on a separate mounting assembly 14 releasably secured to the bench. In use, each support is connected to a separate attachment bracket 16 fixed to the chassis of the vehicle. Usually, bracket 16 attaches a spring or other suspension component to the vehicle. Typically, the vehicle attachment bracket 16 is generally U-shaped with a pair of spaced apart and generally parallel side walls 20 with coaxial mounting holes 22 therethrough (FIG. 4) and a transverse end wall 23.

The bench has a frame 24 with rigid and spaced apart parallel beams 26 each with a pair of parallel and spaced apart tracks 28 extending longitudinally thereon. The mounting assembly has a transverse arm 30 fixed to a base 32 which can be slidably received on a pair of the tracks 28 and releasably secured thereon by bolts 34 extending through the base and threaded into plates 36 slidably received in grooves in the tracks.

To permit the support 10 to be shifted transversely of the bench, a carrier bracket 38 is slidably received on the arm of the mounting assembly. The carrier bracket has an upright plate 40 and a base plate 42 fixed together at a right angle to each other by a pair of gussets 44 welded thereto. A pair of carrier blocks 45 are secured to the upright plate 40 adjacent its upper edge. The bracket can be releasably secured in adjusted position on the arm by a pair of bolts 46 with shanks extending through the base plate and a clamp bar 48 underlying the arm and with nuts received thereon. The support 10 is releasably secured to the bracket 38 by bolts 50 with shanks extending through the upright plate and the support with nuts received thereon.

In accordance with this invention, the support 10 has an externally threaded bushing 52 telescopically received in an internally threaded sleeve 54 fixed to an arm 56 of a mounting plate 58. Stabilizing bars or pads 60 are fixed as by welds to the mounting plate and in use the bars on one side of the mounting plate bear on the upright plate of the bracket. To permit limited longitudinal adjustment of the support 10 relative to the bracket 38, the mounting plate has elongate holes 62 therein through which the bolts 50 are received. The mounting plate 58 has a pair of recess or grooves 63 in its side faces with upper edges 65, one of which in assembly is received in load bearing relationship on the carrier blocks 45 of the bracket 38.

To facilitate bearing on inner faces of the side walls 20 of the vehicle attachment bracket and thereby provide support adjacent the holes 22 through the bracket, both the nose end of the bushing and the ends of the sleeve have generally flat faces 64 & 66 thereon. So that the same support can be used on either side of the vehicle, preferably, both ends of the sleeve have flat faces 66 and the sleeve and bushing are threaded throughout so that the bushing can be threaded into the sleeve from either end thereof. To facilitate turning the bushing, its nose portion has a pair of generally opposed flats 68 thereon providing a non-circular cross-section which can be readily engaged by a wrench or other hand tool for turning the bushing.

As shown in FIG. 1, in using the support 10 to mount a vehicle chassis on the bench, the vehicle is rolled onto or otherwise disposed over the frame 24 of the bench. Preferably the support 10, carrier bracket 38 and mounting assembly 14 are all loosely assembled together and on the tracks 28 of the bench. The vehicle chassis bolt 70 and the spring or other component received in the bracket are removed. Normally, the vehicle is temporarily supported by a jack or other device when the chassis bolt and suspension components are removed. The bushing 52 and sleeve 54 assembly are positioned in the bracket 16 generally in alignment with its mounting holes 22 by shifting the support laterally on the arm 30 of mounting assembly 14 and the mounting assembly longitudinally on the bench.

Figure 4:
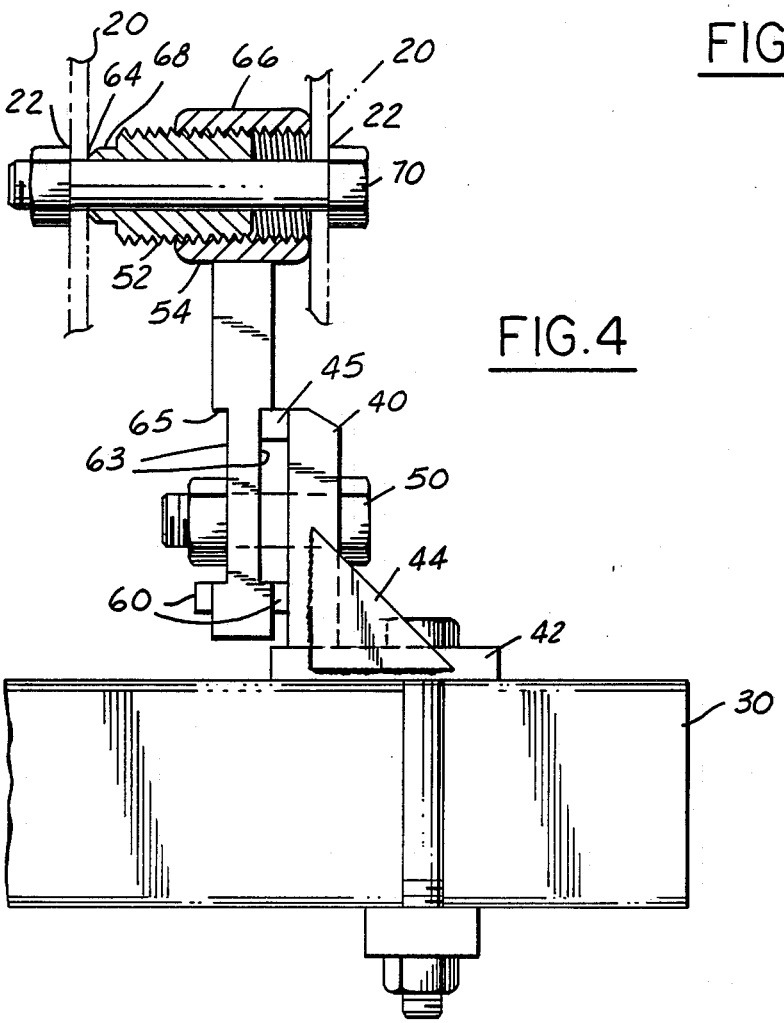
FIG. 4 is an end view partially in section of the support and carrier assembly.

As shown in FIG. 4, preferably the bushing 52 is rotated so that the threads cause it to move axially outward sufficiently to urge the bushing and sleeve into firm engagement with the opposed inner faces of the attachment bracket walls 20. To connect the support to the bracket, the shank of the mounting bolt 70 is inserted through the bushing sleeve and both walls of the bracket and preferably the nut is loosely threaded thereon. Thereafter, the various bolt and nut assemblies are tightened to firmly clamp the support 10 to the bracket 38, the bracket to the arm 30 of the mounting assembly 14 and the mounting assembly to the bench.

Preferably, the bracket is also secured to the support by tightening the chassis bolt 70 and nut. The telescopically expanded bushing and sleeve prevent the walls of the attachment bracket from being bent or even collapsed when the mounting bolt and nut are tightened. They also insure the walls of the bracket will remain in column or alignment so that they do not buckle when the load of the vehicle chassis is placed thereon and when straightening forces applied to the chassis are resisted through the bracket. After the vehicle is secured to the bench by the support 10, the jack or other temporary supporting device is removed. Thereafter, the usual bending, straightening, measuring and other alignment operations can be performed on the vehicle while it is supported on the bench. When desired, the support 10 can be disconnected from the vehicle attachment bracket and the spring or other suspension component resecured thereto by generally reversing the order of the above steps for connecting the support to the bracket.

In accordance with this invention, when the vehicle is mounted on the alignment bench adjacent one end, such as the rear end, with a pair of laterally spaced apart supports 10 generally co-axially aligned on an axis transverse to the longitude of the vehicle, the vehicle chassis can be pivoted or rocked about this transverse axis as indicated by the arrows 72 (FIG. 1). This enables the angular orientation of the chassis relative to the alignment bench to be varied, if desired, which facilitates some straightening operations and the removal and installation of some parts of the vehicle.

I claim:

1. A support for mounting on an alignment bench a vehicle chassis having an attachment bracket with a pair of spaced apart walls with generally coaxial holes therethrough for receiving the shank of a fastener for a component part of the vehicle, said support comprising: an arm constructed and arranged to be releasably carried by the alignment bench, a bushing and a sleeve complementarily threaded and telescoped together so that the axial length between their distal ends can be increased and decreased by relative rotation of said bushing and sleeve, one of said bushing and sleeve being secured to said arm and the other being rotatable relative to said arm, a hole extending generally axially through said bushing and sleeve, said arm, bushing and sleeve being constructed and arranged so that the bushing and sleeve can be inserted between the walls of a vehicle attachment bracket and the other of said bushing and sleeve rotated to extend the axial length of the bushing and sleeve assembly so that its distal ends are disposed closely adjacent the inner faces of the walls of the bracket with said hole through said bushing and sleeve being generally aligned with the holes through the walls of the bracket for receiving the shank of a fastener therethrough.

2. The support of claim 1 wherein the other of said bushing and sleeve has a non-circular portion adjacent the distal end thereof constructed and arranged to be engaged by a hand tool for rotating it.

3. The support of claim 1 wherein the distal ends of said bushing and sleeve assembly have generally flat faces thereon for bearing on the walls of the vehicle attachment bracket.

4. The support of claim 1 wherein both ends of said one of said bushing and sleeve have generally flat faces thereon each constructed and arranged for bearing on a wall of a vehicle attachment bracket and the other of said bushing and sleeve has on its distal end a generally flat surface constructed and arranged for bearing on a wall of a vehicle attachment bracket.

5. A support for mounting a vehicle chassis on an alignment bench, the vehicle having a component attachment bracket with a pair of spaced apart walls with generally coaxial holes therethrough, to permit the vehicle to pivot relative to said bench and said support, such bench having a pair of parallel longitudinally extending and laterally spaced apart tracks extending longitudinally of said bench, a mounting assembly having a transverse arm fixed to a base which can be slidably received on such tracks and releasably secured thereon, such mounting assembly having a carrier which can be releasably secured on such arm, and said support being releasably secured to such carrier, said support comprising:

a bushing and a sleeve complementarily threaded and telescoped together so that the axial length between their distal ends can be increased and decreased by the rotation of one relative to the other, one of said bushing and sleeve being fixed to said support, a hole extending generally axially through said bushing and said sleeve so they can be inserted between the walls of the vehicle attachment bracket in alignment with the holes thereof, the other of said bushing and sleeve may be rotated to extend the axial length of the bushing and sleeve assembly so that its distal ends are disposed closely adjacent the innerfaces of the walls of the bracket, and the shank of a fastener can be received through the bushing, sleeve, and walls of the bracket so that the walls of the bracket will remain aligned when the load of the vehicle chassis is placed thereon and when straightening forces applied to the chassis are resisted through the bracket.

6. The support of claim 5 which also comprises a pair of supports laterally spaced apart and generally coaxially aligned on an axis transverse to the longitude of the vehicle so that the angular orientation of the longitude of the vehicle chassis relative to the alignment bench can be varied.

* * * * *